United States Patent [19]

Beck et al.

[11] Patent Number: 5,048,420

[45] Date of Patent: Sep. 17, 1991

[54] LOW ENERGY FUSE

[75] Inventors: Michael W. Beck; Malcolm D. Harding, both of Ayrshire, Scotland; Anthony J. Rowe, Edenvale, South Africa

[73] Assignee: Imperial Chemical Industries PLC, London, United Kingdom

[21] Appl. No.: 482,947

[22] Filed: Feb. 22, 1990

[30] Foreign Application Priority Data

Feb. 22, 1989 [GB] United Kingdom ..... 8904026

[51] Int. Cl.[5] ..... C06C 5/00

[52] U.S. Cl. ..... 102/275.3; 102/202.1; 102/202.3; 102/202.13

[58] Field of Search ..... 102/202.1, 202.3, 275.3, 102/202.13

[56] References Cited

U.S. PATENT DOCUMENTS

| | | | |
|---|---|---|---|
| 2,909,418 | 10/1959 | Pearsall | 52/2 |
| 2,974,596 | 3/1961 | Allen | 102/70 |
| 3,113,519 | 12/1963 | Zebree | 102/28 |
| 3,895,577 | 7/1975 | Zebree | 102/29 |
| 3,971,319 | 7/1976 | Larson | 102/24 R |
| 4,040,355 | 8/1977 | Hopler, Jr. | 102/22 R |
| 4,299,167 | 11/1981 | Bryan | 102/202.3 |
| 4,385,652 | 6/1982 | Bryan | 102/202.1 |
| 4,756,250 | 7/1988 | Dias dos Santos | 102/275.1 |

FOREIGN PATENT DOCUMENTS

| | | |
|---|---|---|
| 1587420 | 3/1970 | France . |
| 610069 | 6/1949 | United Kingdom . |
| 757775 | 4/1955 | United Kingdom . |
| 760360 | 10/1956 | United Kingdom . |

*Primary Examiner*—Peter A. Nelson

*Attorney, Agent, or Firm*—Cushman, Darby & Cushman

[57] ABSTRACT

In the field of blasting, an improvement in means for transmitting an initiating signal (non-electrically) to an explosive device to remotely detonate same in accordance with a predetermined delay period of the type which comprises tubing in which there is provided a reactive chemical composition containing at least one fuel component and at least one oxidant in intimate admixture that is capable of propagating a combustion signal from one end of said tubing to the other, the improvement consisting in the use of barium peroxide ($BaO_2$) as the oxidant.

9 Claims, No Drawings

LOW ENERGY FUSE

BACKGROUND OF THE INVENTION

1. Field of the Invention

This invention relates to the field of blasting and is particularly concerned with means for transmitting an initiating signal (non-electrically) to an explosive device to remotely detonate same in accordance with a predetermined delay period.

2. Description of the Prior Art

There have been many proposals for achieving remote detonation of explosives by means of non-electric methods of detonation signal transmission. These include the so-called "shock wave conductors", which consist of plastics tubing containing a fine dusting of particulate chemicals capable of reacting to propagate a percussion wave throughout the length of the tubing, as currently available commercially under the Trade Mark "Nonel". Reactive combinations of chemicals that have to date achieved sufficiently reliable and reproducible performance for practical systems have signal propagation velocities of around 2000 $m.s^{-1}$, which leads to inconveniently long lengths of tubing as delay elements. Achievement of desirable slower propagation velocities has been frustrated by the lack of suitable, reliable, precise, reactive compositions for low energy shock tubes. For an inter-hole delay of, say, 10 milliseconds at, for example, 5 meters interhole separation a propagation velocity of from around 500m $sec^{-1}$ to, at most, say 1000m $sec^{-1}$ would be desired for the low energy fuse to allow for short or at least manageable lengths of tubing to be used. At 20 milliseconds interhole delay the desired maximum propagation velocity would drop correspondingly to about 400 to 500 meters/second.

There have been various past approaches to reducing the overall signal transmission rate of shock tube systems—by interposing pyrotechnic delays along the tube lengths and mechanically by introducing artifacts to the tubing, such as coils, or forming constrictions in the tubing itself.

The literature contains reports of examples of various chemical compositions that give lower signal transmission rates. Thus signal velocities of around 1200 $m.s_{-1}$ have been reported for reactive compositions comprising aluminium and sundry oxidants, e.g. a potassium bichromate, aluminium, sugar mixture at a charge density of 10 $mg.m^{-1}$. Using a more complex pyrotechnic chemical composition made up of lead oxide, zirconium, vanadium pentoxide, silicon and amorphous boron at a charge density of 14 $mg.m^{-1}$ it has been reported that a burning speed of 820 $m.s^{-1}$ was achieved. In the absence of commercial products it has not been possible to assess the reliability or precision of those particular compositions in low-energy shock tube. Applicants attempts to reproduce these reported results and to achieve even lower velocities have generally been unsatisfactory due to difficulties in achieving reproducible performance. Thus in a series of experiments on apparently equivalent samples it is often found that some of the samples will fire, but at irregular speeds and others will simply not propagate the initiated signal the full length of the tubing.

In order to achieve a satisfactory delay period without use of excessive lengths of tubing it is necessary to continue research into ways of reducing the transmission velocity still further. Thus it is an object of the present invention to provide improvements in low energy timing fuses. It is a further object of this invention to provide a shock tube delay element for use in a blasting system.

SUMMARY OF THE INVENTION

Accordingly this invention provides an improvement in low energy timing fuse and shock tube of the type which comprises tubing in which there is provided a reactive chemical composition containing at least one fuel component and at least one oxidant in intimate admixture that is capable of propagating a combustion signal from one end of said tubing to the other, the improvement consisting in the use of barium peroxide ($BaO_2$) as oxidant.

DESCRIPTION OF PREFERRED EMBODIMENTS

The composition is preferably in the form of a substantially continuous fine powder dusting on an inner surface of the tubing. The core loading in a tubing of around I.D. 1.5 mm suitably ranges from about 2 to 100 mg. $m^{-1}$, preferably from about 10 to about 50 $mg.m^{-1}$, depending on the fuel component(s) chosen and the amount of any adjuvants also present. The ratio of fuel component(s) to $BaO_2$ when, as is preferred, $BaO_2$, is the sole solid oxidant present may be from about 2:98 to about 80:20, preferably from about 10:90 to 55:45. The fuel may be one or a mixture of metals and pseudo-metals combustible in oxygen e.g. B, Al, S, Se, Ti and W. Important variables of these systems are atomic weight of the fuel, and its particle size and proportions of ingredients in the reactive compositions relative to stoichiometric amounts.

The advantage of barium peroxide as oxidant is that it has a thermal decomposition temperature (circa 800° C.) that is exceptionally well suited for the supply of oxygen to sustain a stable low speed propagation. Stable reproducible (within 5%) propagation speeds at selected values lying in the range of around 400m $sec^{-1}$ to around 800m $sec^{-1}$ have been achieved using different metal/pseudo metal fuels and/or different relative proportions of fuel and $BaO_2$. The controlling signal transmitting reaction is combustion of dispersed fuel "dust" with this liberated oxygen, although any oxygen already present in the tube, e.g., as air, will also become involved.

This invention is especially directed at shock tube having a signal propagation speed intermediate between conventional "Nonel" tubing (circa 2000 $ms^{-1}$) and safety fuse cord (less than 1m $sec^{-1}$) and in that context while mixed fuels may be readily considered, mixture of $BaO_2$ and other solid oxidants need to be selected with caution. However, in the broader context of shock tubing for which inherent delay timing is not an important issue $BaO_2$ may usefully be used in admixture with other solid oxidants. It will be evident that this invention also provides a delay unit which comprises tubing as aforesaid.

The invention will now be illustrated further by way of the following examples in which proportions are by weight.

EXAMPLE 1

A low energy fuse was produced by adding a mixture of fine aluminium and barium peroxide, in a weight ratio of 10:90, in a manner known per se in the art to a 1.5 mm ID tubing made of "Surlyn" (a trade mark of Du Pont).

The core load per linear meter was about 50 mg. A velocity of about 760 $m.s^{-1}$ was recorded. This result was repeatable within 5%.

EXAMPLE 2

A further low energy fuse was produced and tested in a manner generally similar to that of Example 1 but the ratio of Al fuel to $BaO_2$ was 15:85. The core loading was 20 $mg.m^{-1}$ of tubing. A velocity of about 800 $m.s^{-1}$ was recorded and this was reproducible within 5%.

EXAMPLE 3

Following the procedures of Examples 1 and 2, a third signal transmission element was made using a ratio of Al:$BaO_2$ of 20:80 at a core loading of 30 mg per meter length of tubing. Results of testing samples of the element revealed a velocity of about 790 $m.s^{-1}$ was obtainable in a reproducible manner (within 5%).

EXAMPLE 4

A low velocity signal transmission element was made according to procedures broadly similar to those of the foregoing Examples except that the reactive chemical composition was altered to vary the fuel component. Using silicon and barium peroxide as a finely ground particulate mixture, of particle size circa 2 microns, in a weight ratio of 25:75 respectively at a core loading of about 36 $mg.m^{-1}$, a strong, apparently uniform, signal was propagated over a length of tubing at about 400 $m.s^{-1}$.

EXAMPLE 5

Using the fuel and oxidiser components of Example 4 in a ratio of 10:80 respectively, an element capable of reliably transmitting a detonation signal at a characteristically higher speed was produced.

COMPARATIVE EXAMPLE

Similar elements were formed using Al and $KMnO_4$ in a ratios ranging from 6:94 up to 20:80. A composition containing these fuel and oxidiser components in a weight ratio of 11:89 at a core loading of 25 $mg.m^{-1}$ achieved a reproducible and consistent velocity of about 1200 $m.s^{-1}$, too fast for practical use as a timing fuse. A composition containing these fuel and oxidiser components in a weight ratio of 20:80 at a core loading of 25 $mg.m-1$ provided an unstable propagation speed down the tube length, oscillating erratically about 800m $sec^{-1}$.

What is claimed is:

1. In a shock tube suitable for use in a blasting system for the remote detonation of an explosive after a predetermined delay period, said shock tube being of the type which comprises plastic tubing on the inner surface of which there is provided an adherent particulate coating of a reactive chemical composition containing at least one fuel component and at least one oxidant in intimate admixture that is capable of propagating a combustion signal from one end of said tubing to the other, the improvement wherein the oxidant is barium peroxide ($BaO_2$), the barium peroxide providing oxygen in a supply such as to sustain stable low speed propagation of the signal.

2. A shock wave conductor of the type formed of plastic tubing, having an inner surface coated with a particulate reactive chemical composition containing at least one fuel component and at least one oxidant in an intimate admixture that is capable of propagating a combustion signal from one end of said tubing to the other, wherein said composition comprises fuel and barium peroxide ($BaO_2$) mixed particles.

3. The shock wave conductor of claim 1 or claim 2, wherein barium peroxide is the sole solid oxidant present in the reactive composition.

4. The shock wave conductor of claim 1 or claim 2 wherein the tubing has an inside diameter of about 1.5 mm and the core loading in such tubing is in the range of about 2 to bout 100 $mg.m^{-1}$.

5. The shock wave conductor of claim 1 or claim 2 wherein the tubing has an inside diameter of about 1.5 mm and the core loading in such tubing is in the range of about 10 to about 50 $mg.m^{-1}$.

6. The shock wave conductor of claim 1 or claim 2 wherein the ratio of fuel to $BaO_2$ is from 2:98 to 80:20.

7. The shock wave conductor of claim 1 or claim 2 wherein the ratio of fuel to $BaO_2$ is from 10:90 to 55:45.

8. The shock wave conductor of claim 1 or claim 2 wherein the composition of fuel and oxidant provides a signal propagation speed in the range of about 400 $m.s^{-1}$ to about 800 $m.s^{-1}$.

9. The shock wave conductor of claim 1 or claim 2 wherein the fuel is selected from the group consisting of B, Al, S, Se, Ti and W.

* * * * *